US005376412A

United States Patent [19]

Najotte et al.

[11] Patent Number: 5,376,412

[45] Date of Patent: Dec. 27, 1994

[54] PROCESS FOR MANUFACTURING STRINGS TO BE SUBJECTED TO TENSILE STRESS, IN PARTICULAR STRINGS FOR RACKETS AND MUSICAL INSTRUMENTS, AND STRINGS OBTAINED THEREBY

[75] Inventors: Michel M. Najotte, Valence; Michel O. Guyot, Neuilly Sur-Seine; Guy J. Delcroix, Paris, all of France

[73] Assignee: Regnault Reynolds S.A., France

[21] Appl. No.: 798,547

[22] Filed: Nov. 26, 1991

[30] Foreign Application Priority Data

Nov. 26, 1990 [FR] France ..... 90 14754

[51] Int. Cl.[5] ..... B05D 1/36; B05D 3/02; B05D 3/12

[52] U.S. Cl. ..... 427/412; 427/175; 427/299; 427/358; 427/407.1; 427/407.3; 427/409; 427/410

[58] Field of Search ..... 427/175, 358, 412, 407.3, 427/410, 409, 299; 57/242

[56] References Cited

U.S. PATENT DOCUMENTS

| | | | |
|---|---|---|---|
| 1,890,292 | 12/1932 | Hinsky | 427/358 |
| 2,252,755 | 8/1941 | Bruestle | 427/358 |
| 2,627,103 | 2/1953 | Jennings | 427/175 |
| 2,863,787 | 12/1958 | Osborne | 427/175 |
| 2,946,181 | 7/1960 | Tissot et al. | 427/175 |
| 3,738,096 | 6/1973 | Crandall | 57/242 |
| 3,745,756 | 7/1973 | Crandall | 57/234 |
| 3,920,658 | 11/1975 | Benson | 427/416 |
| 3,924,028 | 12/1975 | Benson et al. | 427/175 |
| 4,043,555 | 8/1977 | Conn | 57/362 |
| 4,076,098 | 2/1978 | Ward | 427/407.3 |
| 4,338,357 | 6/1982 | Pichler et al. | 427/407.3 |
| 4,474,585 | 10/1984 | Gruber | 427/412 |
| 4,532,154 | 7/1985 | Harteman | 427/175 |
| 4,707,977 | 11/1987 | Cousin | 156/148 |
| 4,787,200 | 11/1988 | Inada et al. | 57/242 |
| 4,954,377 | 9/1990 | Fischer et al. | 427/389.9 |
| 4,997,703 | 3/1991 | Gehrig | 427/412 |
| 5,047,263 | 9/1991 | Glemet | 427/407.3 |

FOREIGN PATENT DOCUMENTS

| | | | |
|---|---|---|---|
| 3033285 | 2/1991 | Japan | 57/242 |
| 3269187 | 11/1991 | Japan | 57/242 |

*Primary Examiner*—Shrive Beck
*Assistant Examiner*—Diana Dudash
*Attorney, Agent, or Firm*—Anthony J. Casella; Gerald E. Hespos

[57] ABSTRACT

The process for manufacturing strings according to the invention is of the type comprising a step in which a thread is produced from fibres, a step in which the thread is impregnated with a resin, a step in which the impregnated thread is coated with a synthetic material to provide it with a sheath, a step in which the synthetic material is caused to be completely cross-linked, and a step in which the thickness of the sheath is adjusted. It is characterized by use of discontinuous fibres that are subjected to textile operations of intersecting and drawing-twisting. The process according to the invention makes it possible to produce strings designed to be subjected to tensile stress, in particular strings for rackets and musical instruments.

13 Claims, No Drawings

PROCESS FOR MANUFACTURING STRINGS TO BE SUBJECTED TO TENSILE STRESS, IN PARTICULAR STRINGS FOR RACKETS AND MUSICAL INSTRUMENTS, AND STRINGS OBTAINED THEREBY

The present invention relates to a process for manufacturing strings to be subjected to tensile stress, in particular strings for rackets and musical instruments, including a step in which a thread is produced from fibres, a step in which the thread is impregnated with a resin, a step in which the impregnated thread is coated with a synthetic material to provide it with a sheath, a step in which the synthetic material is caused to be completely cross-linked, and a step in which the thickness of the sheath is adjusted.

The strings obtained by implementing this process comprise a central thread composed of continuous fibres. When they are fitted on rackets, these strings tend to vibrate under the impacts of balls and to transmit their vibrations to the arm of the player. Now, these vibrations risk generating anatomical lesions known as "tennis elbow" having adverse effects both on the playing and on the health of the player.

The present invention proposes more particularly to overcome this drawback and, to do so, it provides a process for manufacturing strings to be subjected to tensile stresses, a process of the type comprising the above-mentioned steps and which is characterized in that, in order to produce the thread, use is made of discontinuous fibres that are subjected to textile operations of intersecting and drawing-twisting, the object of intersecting being to orientate the fibres so that they are parallel to one another, while drawing-twisting enables a continuous thread to be obtained.

The discontinuous fibres make it possible to obtain a string that is capable of limiting and damping more swiftly the vibrations that are applied thereto when it is subjected to tensile stress. By fitting this string on a racket, one can thus prevent the vibrations due to the impacts of balls from being transmitted to the arm of the player and affecting the latter's performance.

To obtain a string possessing excellent damping power, it is desirable for the discontinuous fibres to have a length in the order of 20 to 500 mm, and preferably 50 to 250 mm, a number in the order of 1 to 100 dtex, and preferably from 1 to 20 dtex, and curliness in the order of 4 to 12 curls per centimeter.

It is advantageous, moreover, to use discontinuous fibres made of at least one material chosen from the group comprising natural textile fibres, carbon, glass, metalloids, metals, metallic alloys, polyesters, polyethers, polyurethanes, polyamides, polyolefins, acrylic compounds, vinyl compounds and aramids.

It should be noted here that the discontinuous fibres can be solid or hollow and be of any cross-section, for example round, elliptical, triangular, square, rectangular or have several lobes.

When the process according to the invention is implemented, it is appropriate to carry out intersecting and drawing-twisting steps before the impregnation step, which can be effective by immersing the thread in a tank containing the resin in liquid state.

It is desirable, moreover, to cause the impregnating resin to be completely cross-linked before coating the thread, cross-linking being effected when the thread is placed under tension.

Cross-linking carried out under tension makes it possible to obtain a good bond between the resin and the fibres and, consequently, a string possessing better tensile strength.

According to the invention, the impregnating resin and the synthetic material used to form the sheath can be of the same kind and consist of a material chosen from the group comprising polyesters, polyethers, polyamides, epoxides, polyurethanes, cyanoacrylates, acrylic compounds, vinyl compounds and phenolic compounds, it being possible to associate these different materials with solvents, and possibly with dyes.

According to another characteristic of the process according to the invention, the impregnated thread can advantageously be polished before it is coated with the synthetic material, this polishing being carried out, for example, by passing the thread between flexible abrasive discs.

According to yet another characteristic of the process according to the invention, the impregnating resin can be caused to be cross-linked by heating the thread in an oven the temperature of which is adjusted to prevent shrinkage or other damage to the discontinuous fibres.

By way of example, it should be noted that the impregnated thread is caused to pass through the oven so as to dwell therein for a period in the order of 10 seconds to 10 minutes, and preferably from 30 seconds to 3 minutes.

To obtain a string of constant diameter, the thickness of the sheath can advantageously be adjusted by passing the coated thread through a series of dies of decreasing diameters. At the outcome of this calibrating operation the thickness of the sheath can be in the order of 0.05 to 0.5 mm.

The present invention equally applies, of course, to strings obtained by implementing the above-described process, such strings being intended for use in applications wherein they are liable to undergo tensile stress, such as, for example, on rackets or musical instruments.

We claim:

1. A process for manufacturing a string for a sports racket or a musical instrument, such that said string dampens vibrations applied to said string when said string is subjected to tensile stress, said process comprising the steps of:

providing discontinuous fibres, each of said fibres having a length of 20 to 500 mm, a number of 1 to 100 dtex and having 4 to 12 curls per centimeter;

subjecting the fibres to operations of intersecting and drawing-twisting to produce a continuous thread;

impregnating the continuous thread with a resin;

coating the impregnated thread with a synthetic material to form a sheath on said impregnated thread;

causing the synthetic material forming the sheath to be completely cross-linked; and then adjusting the thickness of the sheath.

2. Process according to claim 1, characterized in that the discontinuous fibres comprise a material selected from the group consisting of natural textile fibres, carbon, glass, metals, polyesters, polyethers, polyurethanes, polyamides, polyolefins, acrylic compounds and vinyl compounds.

3. Process according to claim 1, characterized in that the impregnating resin is caused to be completely cross-linked before the impregnated thread is coated, cross-linking being carried out when the impregnated thread is under tension.

4. Process according to claim 1, characterized in that the impregnating resin and the synthetic material are the same.

5. Process according to claim 1, characterized in that the impregnating resin and the synthetic material forming the sheath independently comprise a material selected from the group consisting of polyesters, polyethers, polyamides, epoxides, polyurethanes, cyanoacrylates, acrylic compounds, vinyl compounds and phenolic compounds.

6. Process according to claim 1, characterized in that the impregnated thread is polished before it is coated with the synthetic material.

7. Process according to claim 1, characterized in that the step of causing the synthetic material forming the sheath to be completely cross-linked is carried out by heating the impregnated thread in an oven at a temperature with prevents shrinkage of the discontinuous fibres.

8. Process according to claim 7, characterized in that the impregnated thread is passed through the oven so that it dwells therein for a period of 10 seconds to 10 minutes.

9. Process according to claim 1, characterized in that the thickness of the sheath is adjusted by causing the coated thread to pass through a series of dies of decreasing diameters.

10. Process according to claim 1, characterized in that the adjusting step is carried out such that the sheath achieves a thickness in the order of 0.05 to 0.5 mm.

11. A process according to claim 1 characterized in that the discontinuous fibres have a length of 50 to 250 mm.

12. A process according to claim 1 characterized in that the discontinuous fibres have a number of 1 to 20 dtex.

13. A process according to claim 8 characterized in that the impregnated thread is passed through the oven so that the thread dwells therein for a period of 30 seconds to 3 minutes.

* * * * *